US006568972B2

(12) United States Patent
Kawashima et al.

(10) Patent No.: US 6,568,972 B2
(45) Date of Patent: May 27, 2003

(54) SWIM FINS

(75) Inventors: Haruo Kawashima, Tokyo (JP); Kenji Kawana, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 09/782,778

(22) Filed: Feb. 13, 2001

(65) Prior Publication Data

US 2001/0016461 A1 Aug. 23, 2001

(30) Foreign Application Priority Data

Feb. 17, 2000 (JP) ..... 2000-039958

(51) Int. Cl.[7] ..... A63B 31/08
(52) U.S. Cl. ..... 441/64
(58) Field of Search ..... 441/55, 60, 64

(56) References Cited

U.S. PATENT DOCUMENTS

| | | | | | |
|---|---|---|---|---|---|
| 4,944,703 | A | * | 7/1990 | Mosier | 441/62 |
| 5,588,890 | A | * | 12/1996 | Garofalo | 441/64 |
| 5,766,050 | A | * | 6/1998 | Maggi | 441/64 |
| 6,053,788 | A | * | 4/2000 | Garofalo | 441/64 |

FOREIGN PATENT DOCUMENTS

| | | | | |
|---|---|---|---|---|
| IT | 644799 | * | 9/1962 | 441/64 |

* cited by examiner

*Primary Examiner*—Stephen Avila
(74) *Attorney, Agent, or Firm*—Butzel Long

(57) ABSTRACT

Swim fins includes an instep of a foot pocket which is provided with a plurality of ribs extending forward from the vicinity of an opening for foot insertion and grooves each defined between each pair of the adjacent ribs and extending forward. The instep is thinner along the grooves than along the ribs.

7 Claims, 3 Drawing Sheets

SWIM FINS

BACKGROUND OF THE INVENTION

This invention relates to swim fins.

Swim fins each comprising a foot pocket and a blade extending forward from a front end of the foot pocket are well known in the art. The foot pocket includes a sole to come in contact with the wearer's sole, an instep to come in contact with the wearer's instep, and transverse opposite side walls extending between these sole and instep. Longitudinally opposite ends of a heel strap are fixed to outer surfaces of the side walls so that a length of the heel strap may be adjusted. The sole is sometimes provided on its inner surface with a plurality of ribs extending forward from the vicinity of an opening for foot insertion and projecting inwardly of the foot pocket. Such ribs facilitate the wearer's feet wearing boots to be inserted into and drawn off from the respective foot pockets.

However, it may be impossible for the presence of the ribs provided on the sole alone to facilitate the insertion of the wearer's feet into the respective foot pockets if the wearer's feet are relatively large with respect to the size of the foot pockets. In this case, drawing off of the wearer's feet from the respective foot pockets may be also difficult.

SUMMARY OF THE INVENTION

It is an object of this invention to provide swim fins designed so that the wearer's feet may be easily inserted into and drawn out from respective foot pockets.

According to this invention, there is provided swim fins each comprising a foot pocket and a blade extending forward from a front end of the foot pocket.

The swim fins comprising the foot pocket further include a sole, an instep and transversely opposite side walls extending between the sole and instep. At least one of the sole and instep is provided on an inner surface thereof with a plurality of ribs extending forward from the vicinity of an opening for foot insertion and grooves each defined between each pair of the adjacent ribs so that the instep is thinner along the grooves than along the ribs and deformed more easily along the grooves than along the ribs.

The swim fins according to this invention advantageously facilitate the wearer to insert and to draw out his or her feet into and from the foot pockets of the insteps and the soles of the respective foot pockets, at least the insteps are provided on their inner surfaces with a plurality of ribs extending forward from the vicinity of the respective openings for feet insertion and the grooves each defined between each pair of the adjacent ribs. With the insteps of the respective foot pockets formed with the elastic material having a low rigidity, the thin grooves each defined between each pair of the adjacent ribs can be stretched to enlarge the circumferential dimension of the foot pockets and thereby to be adapted even for relatively large feet with respect to the foot pockets.

DETAILED DESCRIPTION OF THE PREFERRED EMBODIMENTS

Details of swim fins according to this invention will be more fully understood from the description given hereunder with reference to the accompanying drawings.

Figure 1:
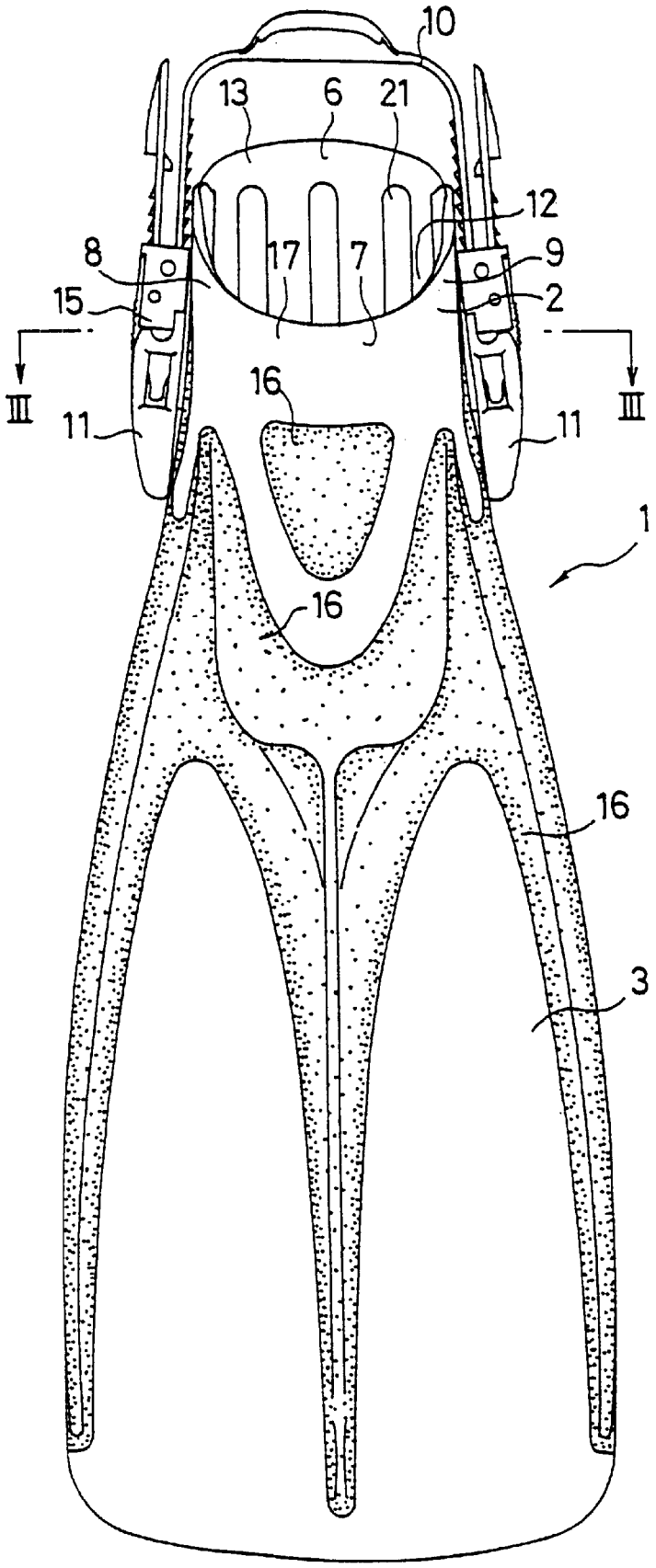
FIG. 1 is a top plan view of swim fins according to one embodiment of the present invention.
Figure 2:
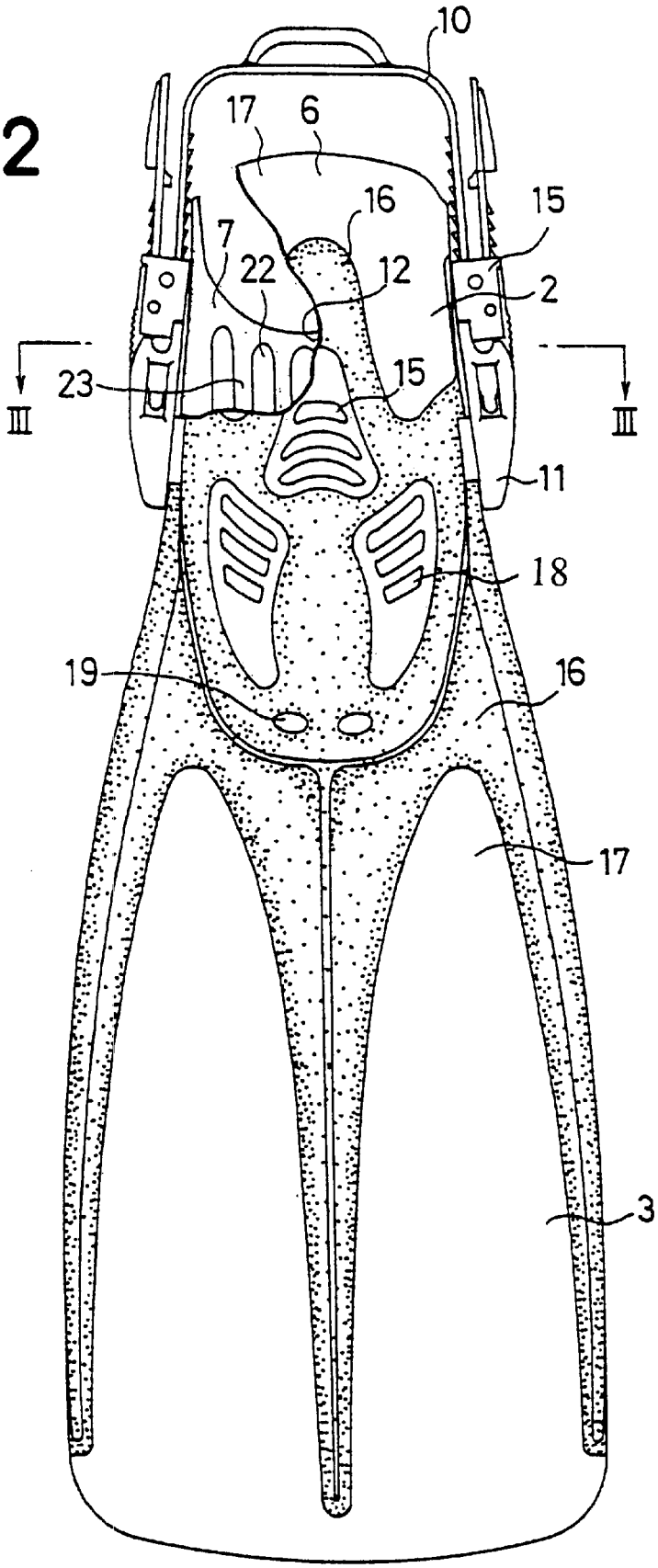
FIG. 2 is a bottom plan view of the swim fins of FIG. 1.

FIG. 1 is a top plan view of a swim fins 1 and FIG. 2 is a bottom plan view thereof. Each of swim fins 1 has a foot pocket 2 and a blade 3 extending forward from a front end of the foot pocket 2. The foot pocket 2 includes a sole 6 to come in contact with the wearer's sole, an instep 7 to come in contact with the wearer's instep and transversely opposite side walls 8, 9 extending between the sole 6 and the instep 7. These components define an opening 12 through which the wearer's foot is inserted into the foot pocket 2. The respective side walls 8, 9 are provided on outer surfaces thereof with bodies 11 of respective buckles into which respective insert members 15 of the respective buckles are detachably inserted from above as viewed in FIGS. 1 and 2. These insert members 15 are attached to a heel strap 10 in the vicinity of its longitudinally opposite ends so that a length of the heel strap 10 may be adjusted. Of the swim fin 1, a dotted region having a plurality of dots is formed with elastoplastics 16 having a relatively high rigidity and a non-dotted region is formed with elastoplastics 17 having a relatively low rigidity except the bodies 11 as well as the insert members 15 of the buckles. The bodies 11 and the insert members 15 of the respective buckles are formed with highly rigid plastics. For example, the elastoplastics 16 may be thermoplastics such as ethylene-vinyl acetate resin and the elastoplastics 17 may be also plastic elastomer such as ethylene-vinyl acetate resin but which is more flexible than the elastoplastics 16. The bodies 11 as well as the insert members 15 may be formed with rigid plastics such as ABS resin.

As will be apparent from FIG. 1, the instep 7 of the foot pocket 2 is formed with the elastoplastics 17 having a relatively low rigidity in the vicinity of the opening 12 for foot insertion and formed with the elastoplastics 16 having a high rigidity in the vicinity of the blade 3. As will be apparent from FIG. 2, the sole 6 of the foot pocket 2 is formed with the plastics 17 having a relatively low rigidity in the vicinity of the opening 12 for foot insertion and with both the elastoplastics 16 having relatively a high rigidity and the elastoplastics 17 having relatively a low rigidity. The sole 6 is provided on its outer surface with a plurality of projections 18 serving as creepers and on its front end with drain holes 19 for the foot pocket 2.

Figure 3:
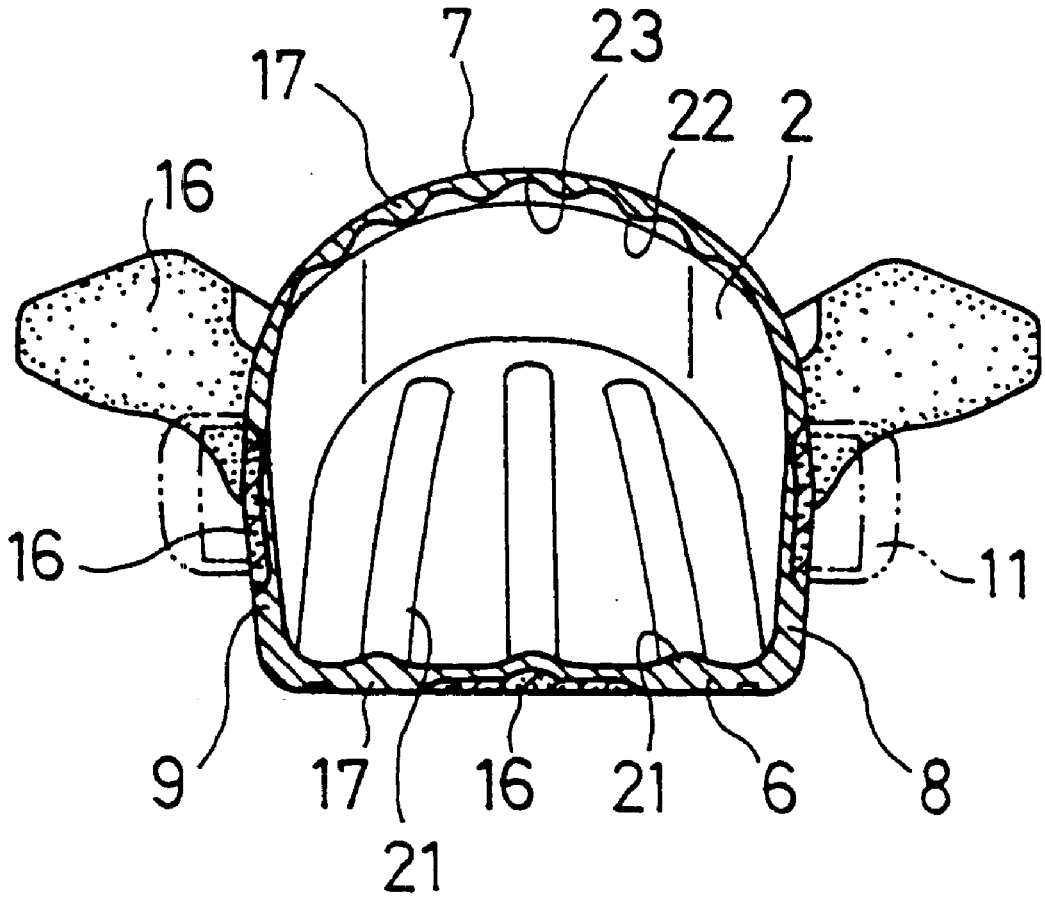
FIG. 3 is a sectional view taken along line III—III in FIGS. 1 and 2.

FIG. 3 is a sectional view of the swim fin 1 taken along line III—III transversely extending in the vicinity of the opening 12 in FIGS. 1 and 2, in which the insert members 15 have been detached from the respective bodies 11 of the buckles and these bodies 11 are indicated by chain lines. The sole 6 of the foot pocket 2 are formed with both the elastoplastics 16, 17 having high and low rigidities, respectively, and the region of the sole 6 formed with the elastoplastics 17 of the low rigidity is thicker than the instep 7 so that this region is not easily deformable. The sole 6 is provided on its inner surface with a plurality of ribs 21 extending forward from the vicinity of the opening 12 and projecting inwardly of the pocket 2 (See FIG. 1 also). The side walls 8, 9 also are formed with a combination of the plastics 16, 17 having high and low rigidities, respectively, so that these side walls 8, 9 may be deformation-resistant even when a tightening force of the heel strap 10 is exerted on these side walls 8, 9 via the bodies 11 of the respective buckles. On the other hand, the instep 7 is formed only with the plastics 17 having a relatively low rigidity and therefore deformable more easily than the sole 6 and the side walls 8, 9. Such instep 7 is provided on its inner surface with a plurality of ribs 22 projecting inwardly of the pocket 2 and grooves 23 each defined between each pair of the adjacent ribs 22 and extending forward. The instep 7 is thinner along the grooves 23 than along the ribs 22 and easily deformable particularly in a circumferential direction of the pocket 2. The ribs 22 have their crests which are sufficiently flat or round to prevent these ribs 22 from irritating the wearer's instep.

Upon insertion of the wearer's feet wearing boots into the pockets 2, each of the boots (not shown) comes in contact, for the most part, with the ribs 21, 22 of the sole 6 and the instep 7 and therefore a contacting area between the boots and the inner surfaces of the respective pockets 2 is relatively small. This feature advantageous facilitates the wearer not only to insert and to draw out his or her feet into or from the pockets 2. In addition, the same dimensioned foot pockets of the fin according to this invention are advantageously compatible with relatively large feet. This is because the thin grooves 23 formed on the instep 7 enable the pockets 2 to be elastically stretched circumferentially of the pockets 2 as these relatively large feet are inserted into the pockets 2. In this way, the inner surfaces of the respective pockets 2 evenly come in contact with the wearer's feet and thereby ensure a comfortable feeling to wear the fin 1. While the sole 6 is also provided on its inner surface with the ribs 21 and the thin region defined between each pair of the adjacent ribs 21, these regions can not be dimensioned as thin as those of the instep 7 in order to obtain a high stretchability. This is because the sole 6 must be sufficiently rigid and non-stretchable to stabilize the wearer walking. The ribs 22 of the instep 7 serve also to ensure an appropriate rigidity of the instep 7 in its longitudinal direction and to stabilize shapes of the foot pockets 2. The ribs 21, 22 preferably have a length at least of 10 mm, more preferably of 20 mm.

It is possible without departing from the scope of this invention to form the inner surface of the respective side walls 8, 9 of the foot pocket 2 also with ribs extending forward. It is also possible to replace at least one of the elastoplastics 16, 17 having high and low rigidity, respectively, by rubber-based material.

What is claimed is:

1. Swim fins each comprising:

a foot pocket, said foot pocket including a sole, an instep and transversely opposite side walls extending between said sole and instep; and a blade extending forward from a front end of said foot pocket, at least one of said sole and instep being provided on an inner surface thereof with a plurality of ribs extending forward from a vicinity of an opening for foot insertion, each of said plurality of ribs being aligned along a longitudinal direction of the foot pocket that extends between the front end and a rear end of the foot pocket, said at least one of said sole and instep further provided with grooves each defined between pairs of adjacent ones of said ribs so that said one of said sole and instep is thinner along said grooves than along said ribs and deformed more easily along said grooves than along said ribs, a portion of said one of said sole and instep in which said ribs and grooves are formed being made of the same material as both said ribs and grooves.

2. The swim fins according to claim 1, wherein said foot pocket is formed at least in a vicinity of said opening for foot insertion so that said instep has a rigidity lower than that of said sole and is elastically stretched more easily than said sole circumferentially of said foot pocket.

3. Swim fins comprising:

a foot pocket, said foot pocket including a sole, an instep and transversely opposite side walls extending between said sole and instep, said side walls are provided on inner surfaces thereof with first ribs extending forward from a vicinity of said opening for foot insertion; and a blade extending forward from a front end of said foot pocket, at least one of said sole and instep being provided on an inner surface thereof with a plurality of second ribs extending forward from a vicinity of an opening for foot insertion and grooves each defined between adjacent ones of said second ribs so that said one of said sole and instep is thinner along said grooves than along said second ribs and deformed more easily along said grooves than along said second ribs, a portion of said one of said sole and instep in which said second ribs and grooves are formed being made of the same material as both said second ribs and grooves.

4. Swim fins each comprising:

a foot pocket, said foot pocket including a sole, an instep and transversely opposite side walls extending between said sole and instep; and a blade extending forward from a front end of said foot pocket, at least one of said sole and instep being provided on an inner surface thereof with a plurality of ribs extending forward from a vicinity of an opening for foot insertion and grooves each defined between said pair of adjacent ones of said ribs so that said one of said sole and instep is thinner along said grooves than along said ribs and deformed more easily along said grooves than along said ribs, wherein said side walls are also provided on inner surfaces thereof with ribs extending forward from a vicinity of said opening for foot insertion.

5. Swim fins each comprising:

a foot pocket, said foot pocket including a sole, an instep and transversely opposite side walls extending between said sole and instep; and a blade extending forward from a front end of said foot pocket, of said sole and said instep, at least said instep being provided on an inner surface thereof with a plurality of ribs extending forward from a vicinity of an opening for foot insertion, each of said plurality of ribs being aligned along a longitudinal direction of the foot pocket that extends between the front end and a rear end of the foot pocket, said at least one of said sole and instep further provided with grooves each defined between pairs of adjacent ones of said ribs so that said instep is thinner along said grooves than along said ribs and deformed more easily along said grooves than along said ribs.

6. The swim fins according to claim 5, wherein said foot pocket is formed at least in a vicinity of said opening for foot insertion so that said instep has a rigidity lower than that of said sole and is elastically stretched more easily than said sole circumferentially of said foot pocket.

7. The swim fins according to claim 5, wherein said side walls are also provided on inner surfaces thereof with ribs extending forward from a vicinity of said opening for foot insertion.

* * * * *